United States Patent [19]

Atsumi

[11] Patent Number: 4,804,607

[45] Date of Patent: Feb. 14, 1989

[54] ELECTROPHOTOSENSITIVE MEMBER HAVING AN OVERCOAT LAYER AND A PROCESS FOR PREPARING THE SAME

[75] Inventor: Fumitoshi Atsumi, Shizuoka, Japan

[73] Assignee: Minolta Camera Kabushika Kaisha, Osaka, Japan

[21] Appl. No.: 101,485

[22] Filed: Sep. 28, 1987

[30] Foreign Application Priority Data

Oct. 4, 1986 [JP] Japan ..... 61-236666

[51] Int. Cl.[4] ..... G03G 5/14

[52] U.S. Cl. ..... 430/67; 427/257; 430/130; 430/132; 430/128; 428/409

[58] Field of Search ..... 430/67, 130, 132, 128; 427/257; 428/409

[56] References Cited

U.S. PATENT DOCUMENTS

| | | | |
|---|---|---|---|
| 3,985,136 | 7/1975 | Makishma et al. | 427/257 |
| 3,992,091 | 11/1076 | Fisher | 355/15 |
| 4,134,763 | 6/1979 | Fujimura | 430/66 X |
| 4,514,483 | 4/1985 | Matsaura et al. | 430/69 X |

FOREIGN PATENT DOCUMENTS

| | | |
|---|---|---|
| 51-56635 | 5/1976 | Japan . |
| 58-59454 | 4/1983 | Japan . |

*Primary Examiner*—J. David Welsh

*Attorney, Agent, or Firm*—Burns, Doane, Swecker & Mathis

[57] ABSTRACT

Disclosed is an electrophotosensitive member and its preparing method. The electrophotosensitive member comprises an electrically conductive substrate, a photosensitive layer, and an overcoat layer having a rough surface with convexities and concavities. The number of convexities and concavities are about 500 to 3000 per 1 cm in a linear distance, and the maximum depth difference of the convexities and concavities is about 0.05 to 1.5 μm. The rough surface having the convexities and concavities is formed directly on the overcoat layer. The electrophotosensitive member according to the present invention reduces the friction coefficient of the contacting area between the electrophotosensitive member and a cleaning device, and improves the durability of the overcoat layer and the photosensitive layer.

8 Claims, 7 Drawing Sheets

ELECTROPHOTOSENSITIVE MEMBER HAVING AN OVERCOAT LAYER AND A PROCESS FOR PREPARING THE SAME

BACKGROUND OF THE INVENTION

1. Field of the Invention

The present invention relates to an electrophotosensitive member for use in the electrophotography process.

2. Description of the Prior Arts

An electrophotosensitive member comprising a support and a photosensitive layer formed on the surface of the support has been known as the conventional electrophotosensitive member for use in the electrophotography process.

In general, the durability and the anti-abrasion property of the surface are required for an electrophotosensitive member for use in the electrophotograpy process to always maintain a favorable electrophotography characteristic even during quite a long period of the repetitive operation.

An electrophotosensitive member having an overcoat layer formed on the photosensitive layer has been known. The purpose of the overcoat layer is for improving the durability and the anti-abrasion property of the photosensitive layer's surface. For instance, the Japanese Published Unexamined Patent Application No. 59454/1983 discloses an electrophotosensitive member having an overcoat layer which comprises inorganic materials, such as silicon oxide (SiO), magnesium oxide (MgO) and the like, coating the surface of the photosensitive layer.

The overcoat layer is effective in protecting the photosensitive layer, but the smoothness of the surface of the overcoat layer is so high that the friction force between the overcoat layer and a cleaning device, which contacts and cleans the overcoat layer, increases, because the contacting area between the overcoat layer and the cleaning device is large. As a result, the durability of the overcoat layer decreases.

On the other hand, U.S. Pat. No. 3,992,091 discloses a technique to form a rough surface on the support to reduce the friction coefficient between the surface of the electrophotosensitive member and the cleaning device which contacts and cleans the surface of the electrophotosensitive member. It forms the rough surface by etching the surface of the support chemically or by a mechanical process before coating and forming the photosensitive layer on the support. However, the process for roughing the surface disclosed in the technique is so complicated that it is disadvantageous from the cost point of view. Further, the above technique is hard to control the roughness of the rough surface because the surface of the photosensitive member is roughed indirectly: first the surface of the support is roughed and then the photosensitive member is formed on the roughed surface of the support.

SUMMARY OF THE INVENTION

It is a major object of the present invention to provide an electrophotosensitive member with an overcoat layer having good durability and anti-abrasion property, and a process for preparing the same.

It is another object of the present invention to provide an electrophotosensitive member with an overcoat layer enabling to reduce the friction coefficient of the contacting area between the electrophotosensitive member and the cleaning device and to improve the durability of the electrophotosensitive member, and a process for preparing the same.

It is a further object of the present invention to provide an electrophotosensitive member with an overcoat layer enabling to reduce the toner adhesion to the electrophotosensitive member by reducing the friction coefficient of the contacting area between the electrophotosensitive member and the cleaning device, and a process for preparing the same.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

A preferred embodiment of the electrophotosensitive member according to the present invention will be explained with reference to FIGS. 1 to 6.

Figure 1:
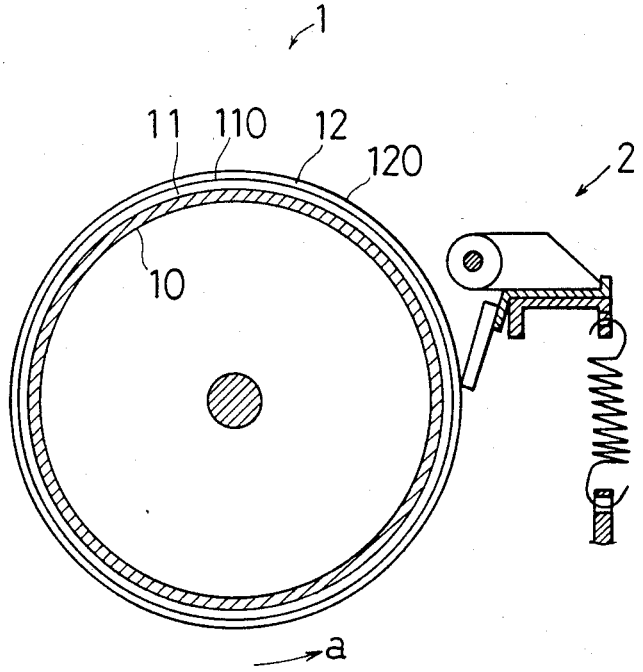
FIG. 1 is a vertical sectional view of a preferred embodiment of an electrophotosensitive member according to the present invention, and a cleaning device.
Figure 2:
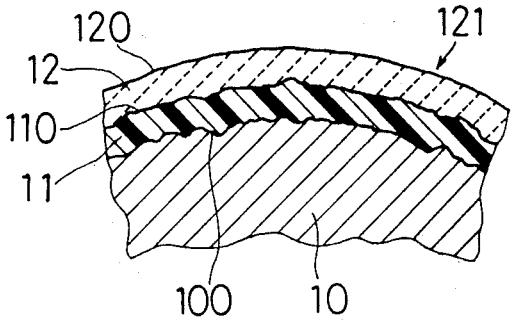
FIG. 2 is a partly enlarged view of FIG. 1.

The electrophotosensitive member 1 rotatably provided in a direction shown by an arrow a has a support 10, a photosensitive layer 11 formed on the support 10, an overcoat layer 12 formed on the photosensitive layer 11 as shown in a vertical sectional view of FIG. 1.

As shown in FIG. 1, the surface of the overcoat layer 12 is in contact with a cleaning device 2 for removing residual toner from the surface of the memmber.

For the support 10 and the photosensitive layer 11 according to the present invention, the conventional support and photosensitive layer may be used.

The support 10 is a conductive cylinder-shaped component, for instance, a cylindrical component made of aluminum.

The photosensitive layer 11 is a layer having the photosensitivity, and is formed on the periphery surface of the support 10. Organic materials or inorganic materials may be used for the photosensitive layer 11. In this preferred embodiment, the photosensitive layer 11 is formed on the surface 100 of the support 10 by using an organic photosensitive resin in which a phthalocyanine pigment is dispersed.

The overcoat layer 12 is formed on the surface 110 of the photosensitive layer 11, and is a film-shaped inorganic material coating the surface 110 of the photosensitive layer 11. Silicon oxide (SiO), silicon dioxide ($SiO_2$), titanium oxide ($TiO_2$), aluminum oxide ($Al_2O_3$) and silicn carbide (SiC) may be used for the inorganic material. The overcoat layer 12 is formed on the surface 110 of the photosensitive layer 11 by a known technique such as the vacuum evaporation using the inorganic material.

The present invention is characterized that the surface 120 of the overcoat layer 12 is the rough surface formed without being affected by the roughness of the support 10 and the roughness of the surface 110 of the photosensitive layer 11.

The overcoat layer 12 is formed on the surface 110 of the photosensitive layer 11, and the rough surface formed on the surface 120 of the overcoat layer 12 has convexities and concavities 121 in an amount of 500 to 3000 per 1 cm linear distance, and the convexities and concavities 121 have a maximum depth difference of 0.05 to 1.5 μm. The rough surface more preferably has convexities and concavities 121 in an amount of 1000 to 1500 per 1 cm linear distance, and the convexities and concavities 121 more preferably have a maximum depth difference of 0.1 to 0.5 μm.

If the amount of the convexities and concavities 121 are 500 or less, or if the maximum depth difference is 0.05 μm or less, the smoothness of the surface of the overcoat layer 12 increases. Accordingly, the surface 120 of the overcoat layer 12 is liable to be damaged because the contacting area between the overcoat layer 12 and the cleaning device 2 increases and the friction force between the overcoat layer 12 and the cleaning device 2 increases.

If the amount of the convexities and concavities 121 are 3000 or more, or if the maximum depth difference is 1.5 μm or more, the filming and the other adverse effects occur because the toners, paper particles and the like enter into the convexities and concavities 121.

Consequently, it is preferred to provide the convexities and concavities 121 having a maximum depth difference of 0.05 to 1.5 μm in an amount of 500 to 3000 per 1 cm linear distance to the surface 120 of the overcoat layer 12.

The overcoat layer 12 is a ceramic layer composed of silicon and oxygen, for instance silicon oxide (SiO). The overcoat layer 12 is formed on the surface 110 of the photosensitive layer 11, which is formed on the surface 100 of the support 10, by the following preparing method:

Firstly, a liquid dispersion composed of alpha-copper phthalocyanine, dibenzylaminohydrazone, acrylic resin and melamine resin is coated on the support 10 by a spray.

Secondly, the coated liquid dispersion is dried to form the photosensitive layer 11 at 100° to 180° C.

Thirdly, the support 10 with the photosensitive layer 11 is placed in a vacuum evaporation chamber (not shown), and vacuum evaporation is performed to form the overcoat layer 12 composed of silicon oxide (SiO) on the photosensitive layer 11 at an evaporation speed of 1 to 500 Å per second in a vacuum degree of 1 to $2\times10^{-5}$ torr.

Figure 3:
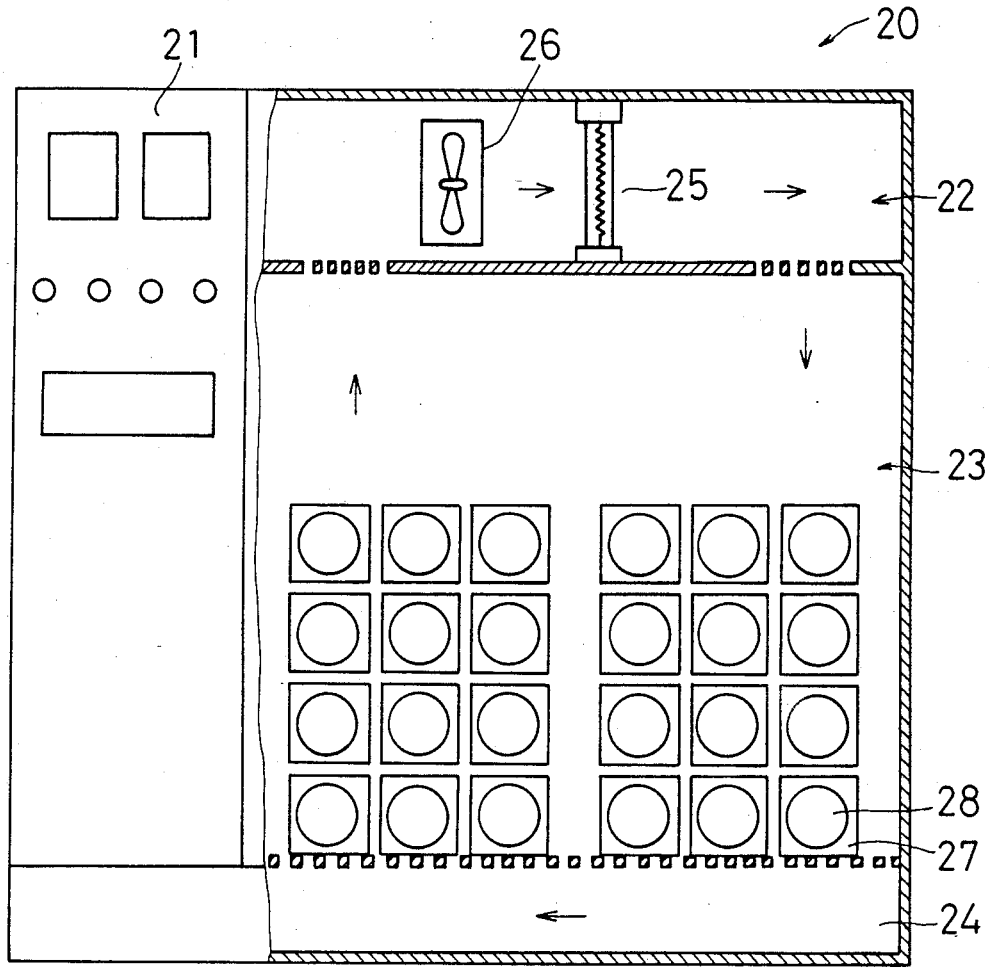
FIG. 3 is a schematic illustration of a heating unit for preparing an electrophotosensitive member according to the present invention.

Finally, the support 10 coated with the photosensitive layer 11 and the overcoat layer 12 is heated to form the wrinkle-shaped convexities and concavities 121 on the surface 120 of the overcoat layer 12 by a heating apparatus 20 shown in FIG. 3.

The heating apparatus 20 is composed of an operation unit 21, a hot wind generator 22, a thermostatic chamber 23, and a support plate 24. The hot wind generator 22 is composed of a heater 25 for generating a hot wind, and a fan 26. A plurality of the supports 10 coated with the photosensitive layer 11 and the overcoat layer 12 (hereinafter referred to as photosensitive members 28) placed in protective cases 27 are set in the thermostatic chamber 23. The photosensitive member 28 is heat-treated while being placed in the protective case 27 because it should be kept away from being blown by the hot air directly. If the portions of the photosensitive member 28 coated with silicon oxide (SiO) overcoat layer 12 are blown by the hot wind directly, a sensitivity undesirably changes in the portions. In addition, the photosensitive member 28 tends to exhibit optical fatigue, therefore the protective case 27 is required to keep the photosensitive member 28 away from the light. The protective case 27 may either be formed of a resin or a paper.

The top and bottom of the thermostatic chamber 23 are net-shaped so that the hot wind generated by the hot wind generator 22 circulates by convection in the direction shown by arrows in FIG. 3.

Figure 4:
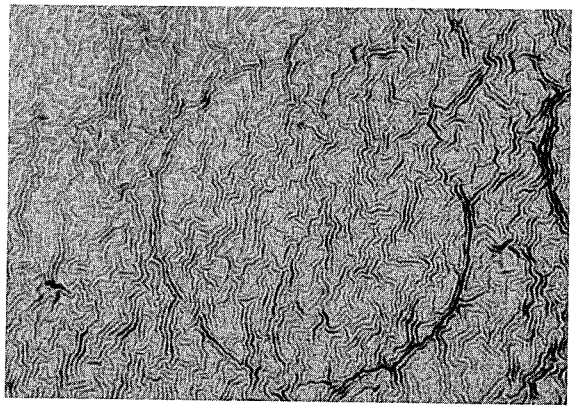
FIG. 4 is a microscope photograph on a crystalline structure of wrinkle-shaped convexities and concavities formed on the surface of an overcoat layer according to the present invention (200× magnification)

The photosensitive member 28 are heated at 60° C. for 24 hours by the heating apparatus 20 thus constructed. The wrinkle-shaped convexities and concavities 121 as shown in the photograph of FIG. 4 are formed by this heat treatment.

Figure 7:
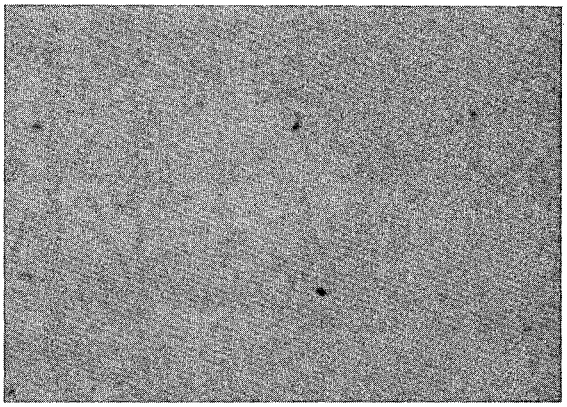
FIG. 7 is a microscope photograph on a crystalline structure of an overcoat layer on the surface of which no wrinkle-shaped convexities and concavities are formed.

For a comparison, FIG. 7 illustrates a surface of the overcoat layer 12 having no convexities and concavities.

Figure 5:
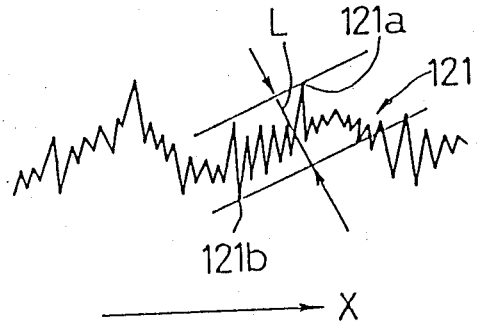
FIG. 5 is an enlarged schematic sectional view for explaining the measurement method of a maximum depth difference of wrinkle-shaped convexities and concavities formed on the surface of an overcoat layer according to the present invention.

These wrinkle-shaped convexities and concavities 121 were measured under the measurement condition of longitudinal magnification of 20,000× and lateral magnification of 100× by using a measuring instrument, the surface roughness tester SEF-10A manufactured by Kosaka Co., Ltd. Namely, the measurement represents a maximum depth difference L between the highest peak **121*a* and the deepest bottom 121*b* of convexities and concavities 121 as shown in FIG. 5, and the amount of convexities and concavities 121** per 1 cm linear distance were also counted in the measurement.

It was found that the wrinkle-shaped convexities and concavities 121 has the maximum depth difference of about 0.1 to 0.5 μm per 1 cm linear distance, and that the amount of wrinkle-shaped convexities and concavities 121 were about 500 to 3000 according to the result of the measurement.

Figure 6:
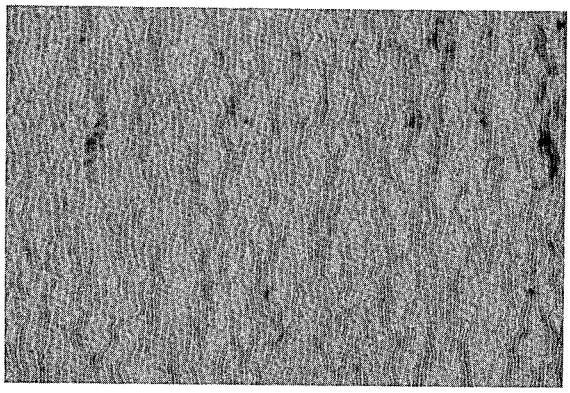
FIG. 6 is a microscope photograph on a crystalline structure of wrinkle-shaped convexities and concavities formed on the surface of an overcoat layer according to the present invention (200× magnification)

The generation of the wrinkle-shaped convexities and concavities 121 on the overcoat layer 12 according to the present invention depends on the heat treatment time. FIGS. 4 and 6 respectively show the rough surface of the overcoat layer 12 obtained by heat-treating at different temperature. The wrinkle-shaped convexities and concavities 121 of another preferred embodiment shown in FIG. 6 were obtained by heat-treating the photosensitive member 28 at 60° C. for one hour.

Four electrophotosensitive members having different maximum depth differences of convexities and concavities 121 on the overcoat surface 120 were prepared by changing the heat treatment temperatures and the heat treatment times in the heating apparatus 20. Namely, the following four electrophotosensitive members having different maximum depth differences, Ls, between the highest peak 121*a* and the deepest bottom 121*b* of convexities and concavities 121 as shown in FIG. 5 were prepared:

Electrophotosensitive member A with 0.5 μm of the maximum depth difference L

Electrophotosensitive member B with 1.0 μm of the maximum depth difference L

Electrophotosensitive member C with 1.5 μm of the maximum depth difference L

Electrophotosensitive member D with 2.0 μm of the maximum depth difference L

The results of a running test, in which the electrophotosensitive members were respectively brought into contact with the cleaning device 2 while 10,000 times of copying were performed, are shown in Table 1.

TABLE 1

Results of the Running Test

| | Electrophotosensitive member | | | |
|---|---|---|---|---|
| | A | B | C | D |
| Damages on the surface of the electrophotosensitive member | o | o | Δ | x |
| Uncleaned portions of the electrophotosensitive member | o | o | x | x |

o: Good,
Δ: Fair,
x: Bad (Four electrophotosensitive members with different surface roughnesses were prepared, and the running test of 10,000 times of copying was performed.)

Regarding the uncleaned toners, it is understood that uncleaned portions had resulted from foreign materials entered into the convexities and concavities 121.

Further, another five electrophotosensitive members having different amounts of convexities and concavities 121 on the overcoat surface 12 were prepared by changing the heat temperatures and the heat treatment times in the heating apparatus 20. Namely, the following five electrophotosensitive members having different amounts of convexities and concavities 121 on the overcoat layer 12 were prepared:

Electrophotosensitive member E with 200 of convexities and concavities 121 on the overcoat layer 12

Electrophotosensitive member F with 500 of convexities and concavities 121 on the overcoat layer 12

Electrophotosensitive member G with 1200 of convexities and concavities 121 on the overcoat layer 12

Electrophotosensitive member H with 3000 of convexities and concavities 121 on the overcoat layer 12

Electrophotosensitive member I with 4500 of convexities and concavities 121 on the overcoat layer 12

The results of a running test, in which the electrophotosensitive members were respectively brought into contact with the cleaning device 2 while 10,000 times of copying were performed, are shown in Table 2.

The following five items were evaluated according to the test results:

(1) Foreign materials, such as paper particles and so on, uncleaned by the cleaning device to remain in the convexities and concavities, (2) Friction force between the cleaning device and the overcoat layer surface (3) Liability of the overcoat layer surface to be damaged during repetitive copying (4) Initial image (5) Blurred image under high moisture condition In Table 2, the respective marks have the following meaning:

o: Good

Δ: Fair (somehow usable)

x: Bad (not usable)

TABLE 2

Results of the Running Test

| | Electrophotosensitive member | | | | |
|---|---|---|---|---|---|
| Evaluation Item | E | F | G | H | I |
| (1) | o | o | o | o | x |
| (2) | x | o | o | o | o |
| (3) | o | o | o | o | Δ |
| (4) | Δ | o | o | o | o |
| (5) | x | o | o | o | o |

As can be seen from the above results, the convexities and concavities 121 reduced the friction coefficient between the overcoat layer 12 and the cleaning device 2 in the preferred embodiment according to the present invention. As a result, the durabilityof the protective layer 12 and the photosensitive layer 11 had increased. The cleaning property had increased and the toner adhesion to the electrophotosensitive member due to the filming and other causes had been reduced because the friction coefficient had been reduced.

The convexities and concavities 121 can be formed on the surface 120 of the overcoat layer 12 easily in accordance with the preferred embodiment of the present invention. The number of the preparing processes has been reduced sharply and the preparing method has become advantageous from the cost point of view because the present invention generates the wrinkle-shaped convexities and concavities 121 on the surface 120 of the overcoat layer 12 only by heat-treating the overcoat layer 12. Contrary to the present invention, the conventional technique forms the convexities and concavities on the support or the photosensitive layer.

Further, the coating amount per unit area of the overcoat layer 12 on the photosensitive layer 11 increased because the wrinkle-shaped convexities and concavities 121 had been formed on the surface 120 of the overcoat layer 12. Accordingly, it was found that the overcoat layer 12 protected the photosensitive layer 11 against ozone ($O_3$) and the like generated during the operation of an electrophotographic copying apparatus better than the conventional electrophotosensitive member.

Figure 8:
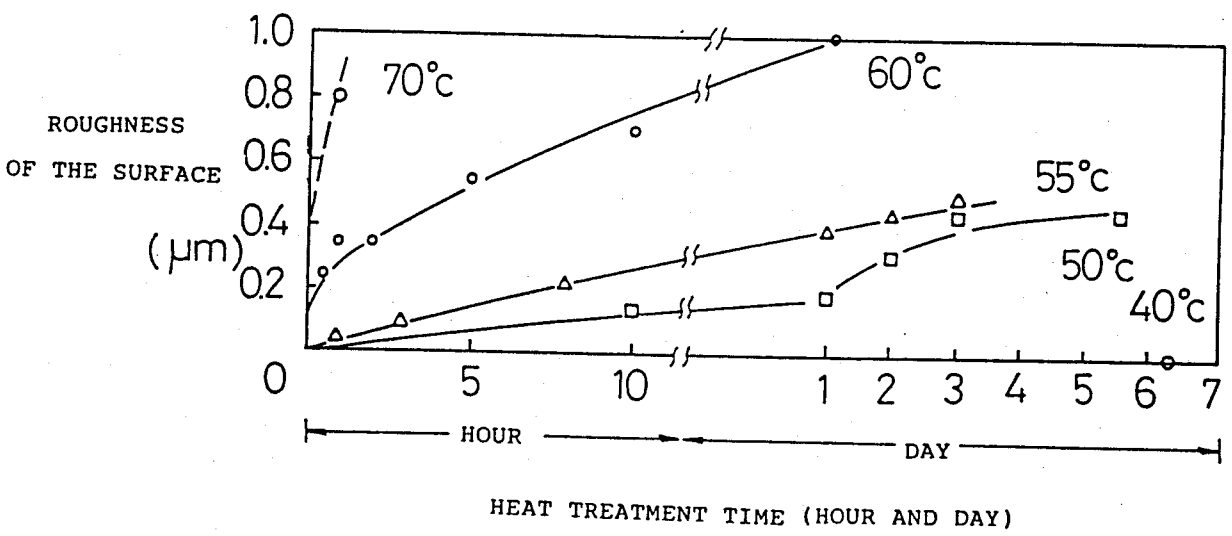
FIG. 8, entitled The Relationship Between The Heat Treatment Time And The Roughness Of The Surface, is a graph for explaining the relationships between the heat treatment times and the roughnesses of the surface of an overcoat layer according to the present invention.

FIG. 8 shows the relationships between the heat treatment times and the roughnesses of the surface of the overcoat layer 12. The roughness of the surface in FIG. 8 means the maximum depth different L between the highest peak 121*a* and the deepest bottom 121*b* illustrated in FIG. 5.

As shown in FIG. 8, no wrinkle-shaped convexities and concavities were formed at the temperature of 40° C. or less.

The formation of wrinkle-shaped convexities and concavities 121 increased sharply in a short period of time at the temperature of 70° C. or more, and it was difficult to control the amount of wrinkle-shaped convexities and concavities 121 by regulating the heat treatment time. (The heat treatment temperature depends on the characteristic of the electrophotosensitive member. The characteristics of the diarsenic triselenide ($As_1Se_3$), cadmium sulfide (CdS) and phthalocyanine organic electrophotosensitive member do not change even if the temperature increases up to approximately 100° C.) Accordingly, it is preferred to perform the heat treatment in the temperature range from 40° C. to 70° C. In addition, it is preferred to maintain the heat treatment temperature at 60° C. during the heat treatment. Furthermore, the formation of the wrinkle-shaped convexities and concavities 121 can be controlled by regulating the heat treatment temperature if the heat treatment time is constant, and it is also controlled by regulating the heat treatment time if the heat treatment temperature is constant.

Figure 9:
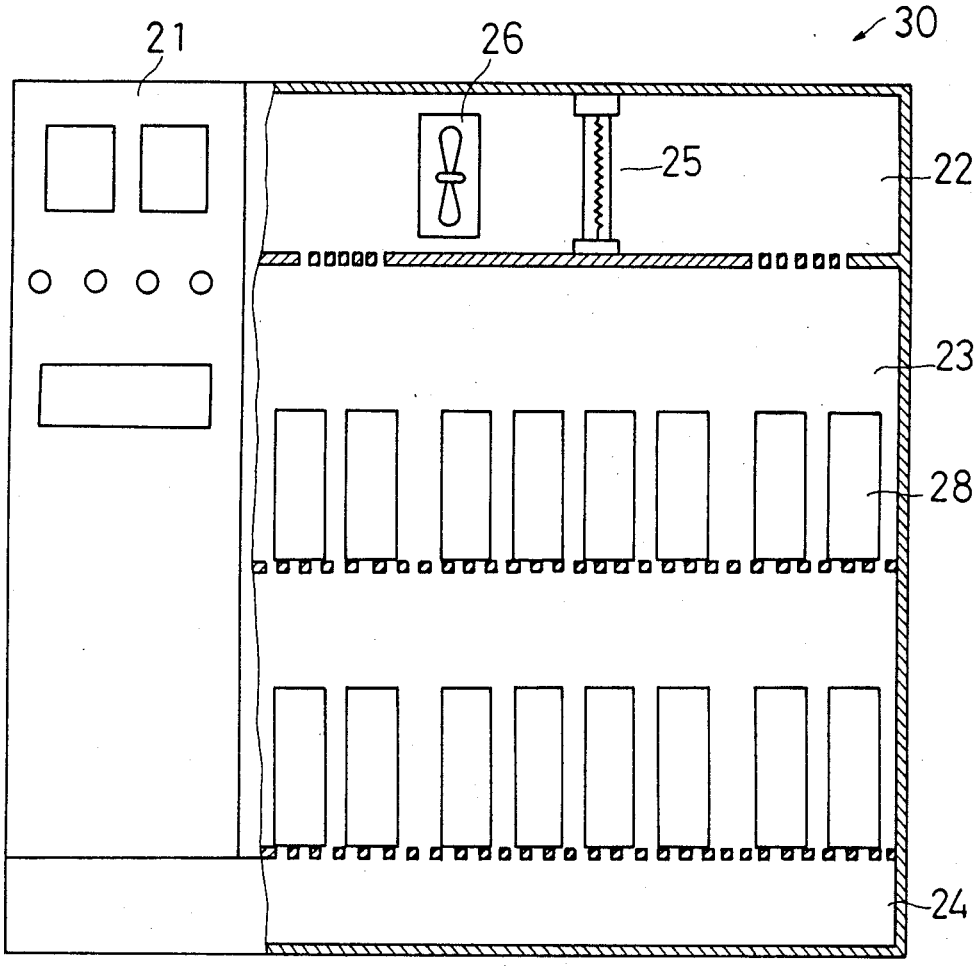
FIG. 9 is a schematic illustration of another heating unit for preparing an electrophotosensitive member according to the present invention.

The heating apparatus for heat-treating the overcoat layer 12 may be the one shown in FIG. 9. The photosensitive members 28 are placed in parallel to the hot wind, so that the hot wind does not blow on the surfaces of the photosensitive members 28 directly. Thus, the temperature distributions on the surfaces of the photosensitive members 28 are kept uniform, and it is possible to perform a heat treatment free from the generation of uneven sensitivities. The inside of the thermostatic chamber 30 should be kept in a darkroom condition because the photosensitive members 28 are not put in the protective cases 27. In the heating apparatus 20 shown in FIG. 3, flanges may be mounted to the phtosensitive members 28 because they are put in the protective cases 27, but in the heating apparatus 30 shown in FIG. 9, the photosensitive members 28 should be placed in an empty state in the heating apparatus 30; i.e. nothing should be mounted to the photosensitive members 28 when placing them in the heating apparatus 30, so that the hot air blows through the photosensitive members 28 well.

The electrophotosensitive member 1 according to the present invention reduces the friction coefficient of the contacting area between the electrophotosensitive member 1 and the cleaning device 2, and improves the durability of the overcoat layer 12 and the photosensitive layer 11 without forming the rough surface of the support 10 and the photosensitive layer 11. Further, the reduced friction coefficient improves the cleaning property of the cleaning device 2, and reduces the toner adhesion on the electrophotosensitive member 1.

Having now fully described the invention, it will be apparent to one of ordinary skill in the art that many changes and modifications can be made thereto without departing from the spirit of scope of the invention as set forth herein.

What is claimed is:

1. In an electrophotosensitive member which comprises;

an electrically conductive substrate, a photosensitive layer formed on said substrate, and an overcoat layer formed on said photosensitive layer, the improvement wherein said overcoat layer has a rough surface having convexities and concavities with a maximum depth difference of about 0.05 to about 1.5 μm in an amount of about 500 to about 3000 per 1 cm in linear distance.

2. An electrophotosensitive member according to claim 1, wherein said rough surface of the overcoat layer is a heat-treated layer.

3. An electrophotosensitive member according to claim 1, wherein said overcoat layer is a heat-treated ceramic layer comprising substantially silicon.

4. An electrophotosensitive member according to claim 1, wherein said photosensitive layer is a layer composed of an organic resin and a phthalocyanine pigment dispersed in said organic resin, and said overcoat layer is a layer composed of an inorganic material selected from the group consisting of silicon oxide (SiO), silicon dioxide ($SiO_2$), titanium oxide ($TiO_2$), aluminum oxide ($Al_2O_3$) and silicon carbide (SiC), and is formed by evaporating said inorganic material in a vacuum.

5. A process for preparing an electrophotosensitive member which comprises; an electrically conductive substrate, a photosensitive layer formed on said substrate, and an overcoat layer formed on said photosensitive layer comprising:

a first step of coating a photoconductive material on said substrate to form said photosensitive layer;

a second step of evaporating an inorganic material in a vacuum to form said overcoat layer on said photosensitive layer; and a third step of heating said support coated with said photosensitive layer and said overcoat layer under a predetermined temperature to form a rough surface on said overcoat layer having convexities and concavities with a maximum depth difference of about 0.05 to about 1.5 μm in an amount of about 500 to about 3000 per 1 cm in a linear distance.

6. A process according to claim 5, wherein said support coated with said photosensitive layer and said overcoat layer is heated at a temperature of about 40° C. to 70° C. at said third step.

7. A process according to claim 5, wherein said support coated with said photosensitive layer and said overcoat layer is heated in a protective case at said third step.

8. A process according to claim 7, wherein said third step is carried out in a thermostatic chamber.

* * * * *